US009217278B2

(12) United States Patent
Riley

(10) Patent No.: US 9,217,278 B2
(45) Date of Patent: Dec. 22, 2015

(54) TRUSS ANCHOR AND TRUSS ASSEMBLY USED FOR REINFORCING GATE

(71) Applicant: EASTERN WHOLESALE FENCE CO. INC., Medford, NY (US)

(72) Inventor: Mark Riley, Sound Beach, NY (US)

(73) Assignee: EASTERN WHOLESALE FENCE CO. INC., Medford, NY (US)

( * ) Notice: Subject to any disclaimer, the term of this patent is extended or adjusted under 35 U.S.C. 154(b) by 0 days.

(21) Appl. No.: 14/252,306

(22) Filed: Apr. 14, 2014

(65) Prior Publication Data

US 2015/0292259 A1 Oct. 15, 2015

(51) Int. Cl.

| | |
|---|---|
| ***E04B 1/38*** | (2006.01) |
| ***E04C 5/00*** | (2006.01) |
| ***E06B 7/28*** | (2006.01) |
| ***E06B 11/02*** | (2006.01) |

(52) U.S. Cl.

CPC .. *E06B 7/28* (2013.01); *E06B 11/02* (2013.01)

(58) Field of Classification Search

CPC ..... E04B 2001/2684; E04B 2001/3583; E04B 1/02; E04B 1/10; E04B 1/26; E04B 1/2604; E04C 2003/0491

USPC ..... 52/698, 699, 700, 703

See application file for complete search history.

(56) References Cited

U.S. PATENT DOCUMENTS

| | | | | |
|---|---|---|---|---|
| 6,003,280 | A * | 12/1999 | Wells | 52/653.1 |
| 2002/0046514 | A1* | 4/2002 | Leung | 52/167.3 |
| 2007/0033895 | A1* | 2/2007 | Talpe | 52/698 |
| 2007/0283659 | A1* | 12/2007 | Whyte et al. | 52/693 |
| 2012/0222380 | A1* | 9/2012 | Wentworth et al. | 52/698 |
| 2014/0013701 | A1* | 1/2014 | Rodgers | 52/698 |

* cited by examiner

*Primary Examiner* — Mark Wendell

(74) *Attorney, Agent, or Firm* — Scully, Scott, Murphy & Presser, P.C.

(57) ABSTRACT

A truss anchor and a truss assembly used with a gate for reinforcing the gate are provided. The truss anchor has a flange defining a first opening, a base opposite to the flange for defining a second opening and a continuous wall extending between the flange and the base. The continuous wall and the base collectively define an open space which is accessible through the first opening. The truss assembly has two of the truss anchors and a rod extending between the truss anchors. The rod has two opposite ends, each end being insertable into the open space of the truss anchor through the second opening. A locking member is used for locking each end and a respective truss anchor. Upon locking the end of the rod and the truss anchor, the flange of the truss anchor abuts against an external surface of the gate and the rod is preloaded with tension.

7 Claims, 5 Drawing Sheets

TRUSS ANCHOR AND TRUSS ASSEMBLY USED FOR REINFORCING GATE

FIELD

The present disclosure relates generally to the field of reinforcing, securing and stabilizing a construction member, such as a gate, and more particularly to a truss anchor and a truss assembly incorporating the truss anchor, which are easy to manufacture and market-attractive.

BACKGROUND

Fences are commonly used to delineate borders between properties, such as between residential homes or lots, or commercial properties. Types and materials used for forming fences may include vinyl, chain link, wood, or stone or brick. Vinyl fences, such as Polyvinyl Chloride (PVC), are preferred as requiring less maintenance than wood fences and more aesthetically pleasing than other types of fencing.

Typically, the gate of the vinyl fences includes a welded gate frame, which is subject to cracking and breaking. Therefore, the gate may fall apart and leave people's backyards exposed and as a result, wandering children may accidentally access the back yard, which poses dangers to both the residents and the children.

Therefore, it is desirable to improve the strength of the gate.

BRIEF SUMMARY

As described herein, the exemplary embodiments of the current invention overcome one or more of the above and other disadvantages known in the art.

An exemplary aspect of the present invention relates to a truss anchor used with a gate for reinforcing the gate. The truss anchor includes a flange defining a first opening; a base opposite to the flange, the base defining a second opening; and a continuous wall extending between the flange and the base. The continuous wall and the base collectively define an open space which is accessible through the first opening. The continuous wall and the base are insertable into a cavity of the gate and the flange is configured to abut against an external surface of the gate associated with the cavity, upon insertion of the continuous wall and the base into the cavity.

Optionally, the flange and the base are substantially circular.

Optionally, the continuous wall is substantially cylindrical.

Optionally, the second opening is smaller than the first opening.

Optionally, the flange and the base are substantially parallel to each other.

Optionally, the flange and the base are angularly disposed with respect to each other.

Another exemplary aspect of the present invention relates to a truss assembly used with a gate for reinforcing the gate. The truss assembly includes a first truss anchor and a second truss anchor, and a rod extending between the first truss anchor and the second truss anchor. Each truss anchor includes a flange defining a first opening; a base opposite to the flange, the base defining a second opening; and a continuous wall extending between the flange and the base, the continuous wall and the base collectively defining an open space which is accessible through the first opening. The rod includes a first end insertable into the open space of the first truss anchor through the second opening of the first truss anchor, and a second end insertable into the open space of the second truss anchor through the second opening of the second truss anchor. The truss assembly further includes a first locking member for engaging the first end of the rod through the first opening of the first truss anchor to lock the first end of the rod to the first truss anchor, and a second locking member configured to engage the second end of the rod through the first opening of the second truss anchor to lock the second end of the rod to the second truss anchor. The continuous wall and the base of the first truss anchor are insertable into a first cavity of the gate and the continuous wall and the base of the second truss anchor is insertable into a second cavity of the gate. Upon locking the first end of the rod to the first truss anchor and locking the second end of the rod to the second truss anchor, the rod is preloaded with tension, the flange of the first truss anchor abuts against a first external surface of the gate associated with the first cavity and the flange of the second truss anchor abuts against a second external surface of the gate associated with the second cavity.

Optionally, the first end and the second end of the rod each comprise external threads and the first locking member and the second locking member each comprise a locknut having internal threads, wherein the internal threads mate with the external threads.

Optionally, the flange and the base of the first truss anchor are substantially circular and the flange and the base of the second truss anchor are substantially circular.

Optionally, the continuous wall of the first truss anchor is substantially cylindrical and the continuous wall of the second truss anchor is substantially cylindrical.

Optionally, the second opening of the first truss anchor is smaller than the first opening of the first truss anchor and the second opening of the second truss anchor is smaller than the first opening of the second truss anchor.

Optionally, the flange and the base are substantially parallel to each other.

Optionally, the flange and the base are angularly disposed with respect to each other.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, the drawings are merely intended to conceptually illustrate the structures and procedures described herein.

DETAILED DESCRIPTION

Figure 1:
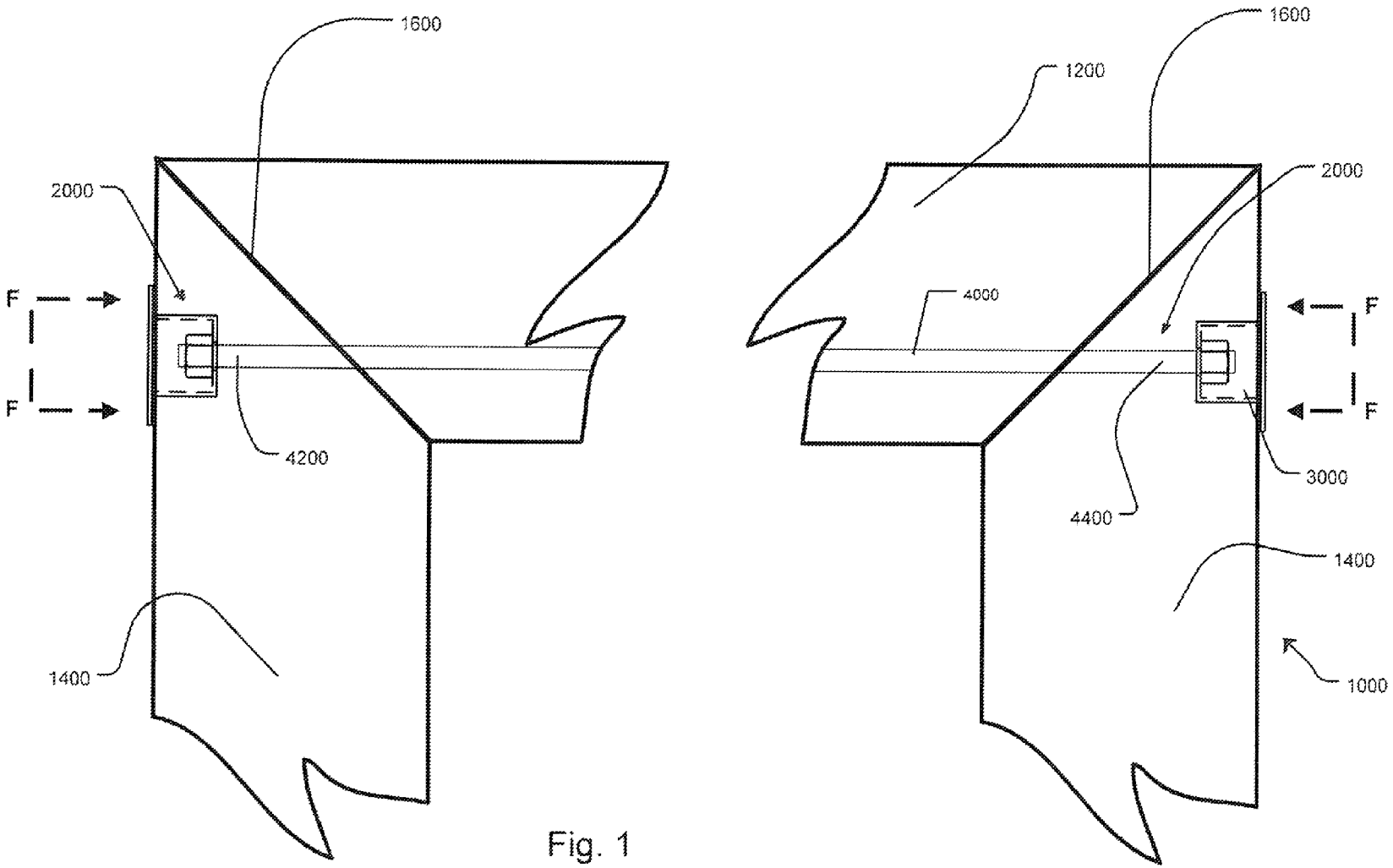
FIG. 1 is a schematic view showing a gate frame reinforced by a truss assembly according to an aspect of the present application.

FIG. 1 schematically illustrates a gate frame 1000, which has been reinforced by a truss assembly 2000. The gate frame 1000 includes a top member 1200, which can extend substantially horizontally, and a pair of side members 1400, which can extend substantially vertically and substantially parallel with each other. The top member 1200 is connected to each side member 1400 at an interface 1600, for example, through heat welding. The top member 1200 and the side members 1400 are shaped, such that the interfaces 1600 therebetween are angularly disposed and substantially planar, although other configurations are contemplatable and within the scope of the present invention. Although not shown in the figure, the gate frame 1000 similarly includes a bottom member, which is also connected to the side members 1400 through respective interfaces.

The truss assembly 2000 includes a pair of first and second truss anchors 3000 disposed oppositely to each other and embedded into the side members 1400 of the frame 1000, respectively. The truss assembly 2000 further includes a rod 4000, which extends substantially between the truss anchors 3000 and across the interfaces 1600 of the frame 1000. The rod 4000 has two opposite first end 4200 and second end 4400, through which the rod is connected to the first and second truss anchors 3000, respectively.

Figure 3:
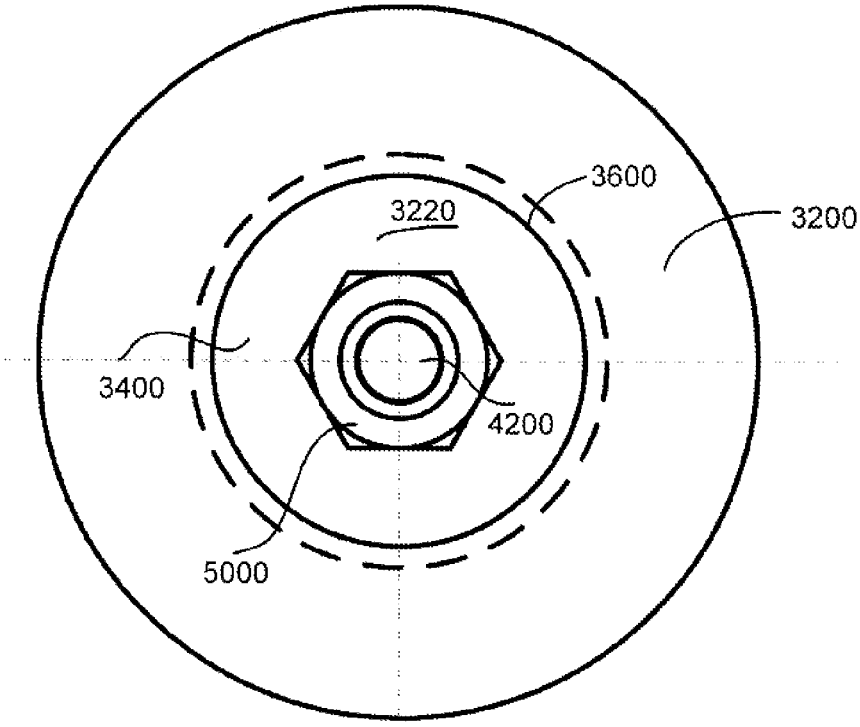
FIG. 3 is a top view of FIG. 2.
Figure 2:
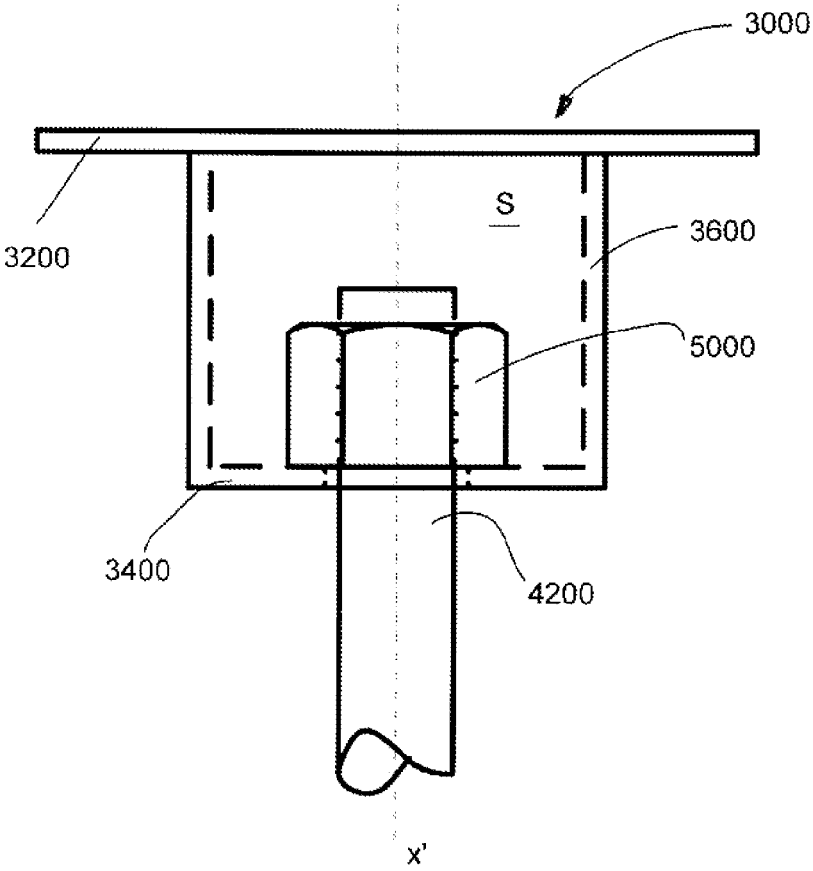
FIG. 2 is a schematic view showing a truss anchor of the truss assembly, which is assembled with an end of a rod of the truss assembly.
Figure 4:
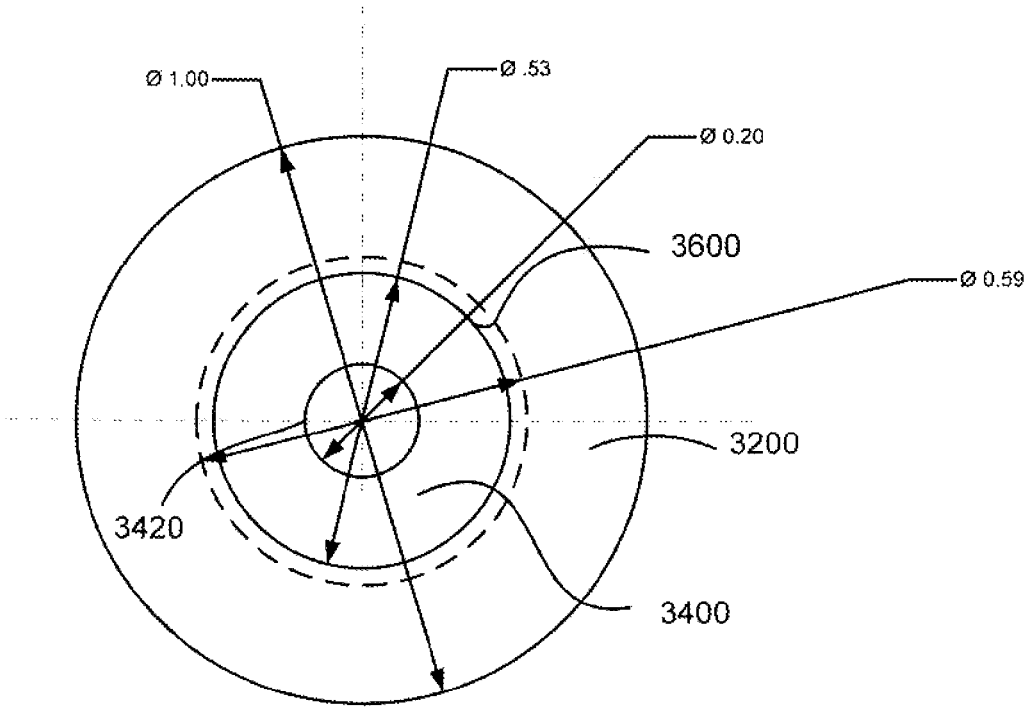
FIG. 4 is a bottom view of the truss anchor of FIG. 2.

FIGS. 2-4 illustrate the truss anchor 3000, which is connected to the first end 4200 of the rod 4000. The truss anchor 3000 includes a flange 3200, which can be circular as shown in the embodiment or any suitable shape or profile. In use, the flange 3200 can abut against a side surface of the side member 1400 of the frame 1000, as shown in FIG. 1, when the truss anchor 3000 is inserted into a cavity of the gate frame 1000. The truss anchor 3000 further includes a base 3400, which is opposite to the flange 3200, and a continuous wall 3600 extending between the flange 3200 and the base 3400. The continuous wall 3600 and the base 3400 collectively define an open space S within the truss anchor 3000. For example, the flange 3200 and the base 3400 are substantially parallel to each other and the continuous wall 3600 is substantially cylindrical. For example, the continuous wall 3600 extends along a longitudinal axis X-X' and is substantially radially symmetric with respect to the axis; the flange 3200 and the base 3400 are also substantially radially symmetric with respect to the axis.

The flange 3200 defines a first opening 3220, which can be dimensioned to substantially correspond to the dimension of the continuous wall 3600. Through the first opening 3220, a user can access the space S to assemble the truss anchor 3000 to the gate frame 1000. The base 3400 defines a second opening 3420, which is dimensioned to allow the insertion of the first end 4200 of the rod 4000 into the space S. The second opening 3420 is generally smaller than the first opening 3220. In use, after the first end 4200 of the rod 4000 has been inserted to the space S, a locking member 5000 is placed into the space S through the first opening 3220 to engage and lock the first end 4200. For example, the first end 4200 can include external threads and the locking member 5000 can be a locknut having internal threads for mating the external threads of the first end 4200. Other suitable and applicable engaging and locking options are within the scope of the invention.

When using the truss assembly 2000 to reinforce the gate frame 1000, the profile of the frame 1000 is drilled through the exterior with holes, which can be 0.625" holes, for allowing the rod 4000 to be inserted from one side of the frame 1000 to an opposite side of the frame 1000, as shown in FIG. 1. Subsequently, the base 3400 and the continuous wall 3600 of the truss anchor 3000 are inserted into the side member 1400 through these holes, such that the first end 4200 of the rod 4000 enters the open space S of the truss anchor 3000 through the second opening 3420 of the base 3400.

Subsequently, the locking member 5000 is placed within the open space S through the first opening 3220 of the flange 3200 to engage the first end 4200 of the rod 4000 to lock the first 4200 end with the truss anchor 3000. For example, the locking member can be a locknut which is threaded and tightened to lock the threaded end of the rod. The opposite truss anchors 3000 can be mounted and assembled simultaneously or separately with respect to the second end 4400 of the rod 4000.

As the locking member 5000 and the ends of the rod 4000 engage each other, a pressure is exerted by the flange 3200 of the truss anchor 3000 against the side surface of the frame 1000, as shown in FIG. 1. Once both anchors are assembled with the rod, the rod is preloaded with tension and accordingly, the inclusion of the linear stress on the rod applies a preload against forces which would otherwise separate the inner corners of the frame (e.g., the interfaces 1600) and cause a weld crack situation of the gate frame.

Figure 5:
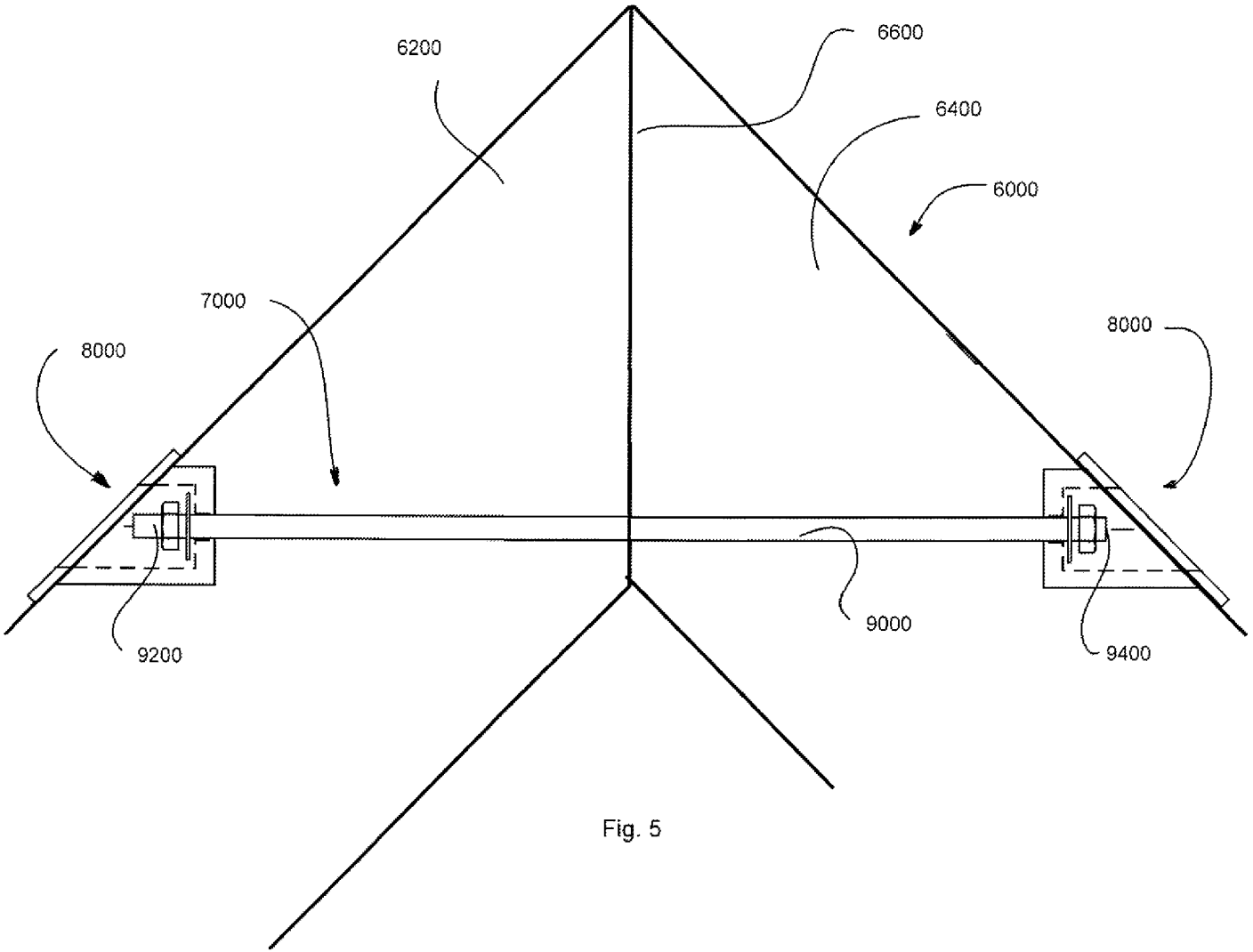
FIG. 5 is a schematic view showing another embodiment of the truss assembly.

FIG. 5 schematically illustrates another embodiment according to an exemplary aspect of the present invention, which includes a gate frame 6000 being reinforced by a truss assembly 7000.

In this embodiment, the gate frame 6000 includes a first member 6200 and a second member 6400, which extend angularly with respect to each other. The first member 6200 and the second member 6400 are joined with each other through an interface 6600. The first member 6200 and the second member 6400 can, for example, form a corner of a fence gate.

The truss assembly 7000 is structurally similar to the truss assembly 2000 as previously described. The assembly 7000 includes a pair of first and second truss anchors 8000, which are disposed oppositely to each other and embedded into an outer surface of the first member 6200 and the second member 6400 of the gate frame 6000, respectively. A rod 9000, extending through the interface 6600, connects both truss anchors 8000. The rod 9000 has two opposite first end 9200 and second end 9400, through which the rod 9000 is connected to the first and second truss anchors 8000, respectively.

Figure 6:
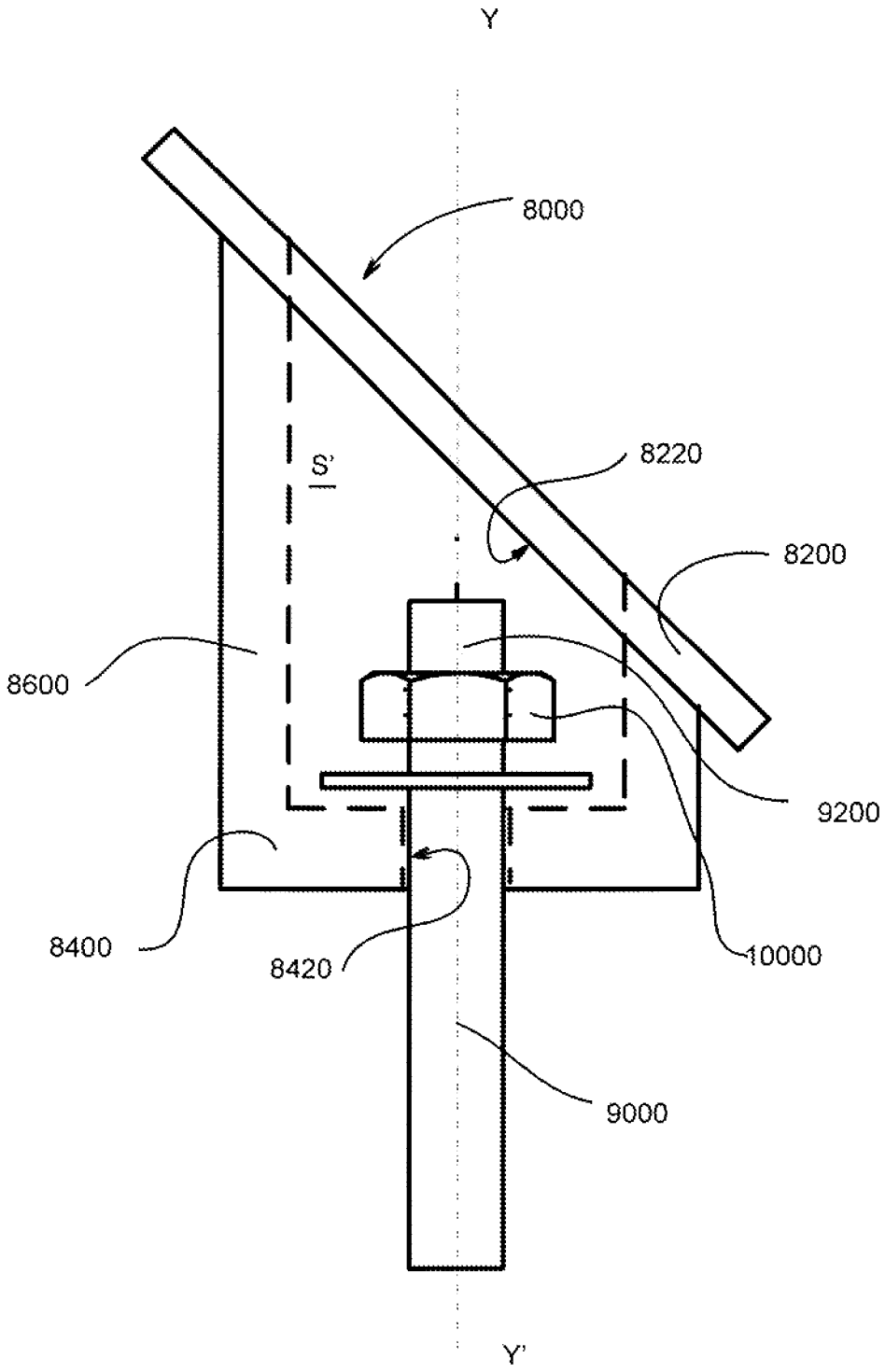
FIG. 6 is a schematic view showing a truss anchor of the truss assembly shown in FIG. 5.

As shown in FIG. 6, the truss anchor 8000, which is connected to the first end 9200 of the rod 9000, includes a flange 8200, a base 8400 and a continuous wall 8600 extending between the flange 8200 and the base 8400. The flange 8200 is adapted to abut against the external surface the first member 6200 of the frame 6000, when the base 8400 and the continuous wall 8600 are inserted into a cavity of the first member 6200. The continuous wall 8600 and the base 8400 collectively define an open space S', which is accessible from the outside. In this embodiment, the flange 8200 extends angularly with respect to the base 8400 to conform to the shape of the external surface of the first member 6200; the continuous wall 8600 is in the shape of a tube that is substantially symmetric with respect to a longitudinal axis Y-Y'.

The flange 8200 defines a first opening 8220, which can be dimensioned to substantially correspond to the dimension of the continuous wall 8600. Through the first opening 8220, a user can access the space S' to assemble the truss anchor 8000 to the first member 6200 of the gate frame 6000. The base 8400 defines a second opening 8420, which is dimensioned to allow the insertion of the first end 9200 of the rod 9000 into the space S'. The second opening 8420 is generally smaller than the first opening 8220. In use, after the first end 9200 of the rod 9000 has been inserted to the space S', a locking member 10000 is placed into the space S' through the first opening 8220 to engage and lock the first end 9200. For example, the first end 9200 can include external threads and the locking member 10000 can be a locknut having internal threads for mating the external threads of the first end 9200. Other suitable and applicable engaging and locking options are within the scope of the invention. The truss anchors 8000 and the rod 9000 can be mounted to the gate frame 6000 through the locking member 10000 in a similar manner as previously described. Once both anchors are assembled with the rod and tightened through the locking member, the rod is preloaded with tension and accordingly, the inclusion of the linear stress on the rod applies a preload against forces which would otherwise separate the inner corners of the frame (e.g., the interfaces 6600) and cause a weld crack situation of the gate frame.

The features of the present invention as applied to various specific embodiments thereof have been shown and described. It will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A combination of a truss assembly and a gate, the gate comprising a first member and a second member, wherein the first member and the second member are angularly connected to each other through an interface, the truss assembly comprising:

a first truss anchor and a second truss anchor, each truss anchor comprising:

a flange defining a first opening;

a base opposite to the flange, the base defining a second opening; and a continuous wall extending between the flange and the base, the continuous wall and the base collectively defining an open space which is accessible through the first opening, a rod extending through the interface of the gate between the first truss anchor and the second truss anchor, the rod comprising:

a first end inserted into the open space of the first truss anchor through the second opening of the first truss anchor; and a second end inserted into the open space of the second truss anchor through the second opening of the second truss anchor, a first locking member provided in the open space of the first truss anchor for engaging the first end of the rod to lock the first end of the rod to the first truss anchor, and a second locking member provided in the open space of the second truss anchor for engaging the second end of the rod to lock the second end of the rod to the second truss anchor, wherein the continuous wall and the base of the first truss anchor are inserted into a cavity of the first member of the gate and the continuous wall and the base of the second truss anchor are inserted into a cavity of the second member of the gate, and wherein, upon locking the first end of the rod to the first truss anchor and locking the second end of the rod to the second truss anchor, the rod is preloaded with tension, the flange of the first truss anchor abuts against an external surface of the first member of the gate associated with the first cavity, and the flange of the second truss anchor abuts against an external surface of the second member of the gate associated with the second cavity.

2. The combination according to claim 1, wherein the first end and the second end of the rod each comprise external threads and the first locking member and the second locking member each comprise a locknut having internal threads, wherein the internal threads mate with the external threads.

3. The combination according to claim 1, wherein the flange and the base of the first truss anchor are substantially circular and the flange and the base of the second truss anchor are substantially circular.

4. The combination according to claim 1, wherein the continuous wall of the first truss anchor is substantially cylindrical and the continuous wall of the second truss anchor is substantially cylindrical.

5. The combination according to claim 1, wherein the second opening of the first truss anchor is smaller than the first opening of the first truss anchor and the second opening of the second truss anchor is smaller than the first opening of the second truss anchor.

6. The combination according to claim 1, wherein the flange and the base are substantially parallel to each other.

7. The combination according to claim 1, wherein the flange and the base are angularly disposed with respect to each other.

* * * * *